US008430272B2

(12) United States Patent
Porter

(10) Patent No.: US 8,430,272 B2
(45) Date of Patent: Apr. 30, 2013

(54) TRIGGER MECHANISM FOR DISCHARGING AEROSOL CONTAINERS

(76) Inventor: Steven P. Porter, Elburn, IL (US)

( * ) Notice: Subject to any disclaimer, the term of this patent is extended or adjusted under 35 U.S.C. 154(b) by 0 days.

(21) Appl. No.: 12/925,178

(22) Filed: Oct. 15, 2010

(65) Prior Publication Data

US 2012/0091167 A1 Apr. 19, 2012

(51) Int. Cl.
*B67D 7/84* (2010.01)

(52) U.S. Cl.
USPC ..... 222/174; 239/532; 239/578

(58) Field of Classification Search ..... 222/79, 222/174, 402.15; 42/DIG. 1; 118/305; 239/526, 239/578, 532
See application file for complete search history.

(56) References Cited

U.S. PATENT DOCUMENTS 1,139,627 A * 5/1915 Baltzley ..... 24/565
2,508,104 A 5/1950 Dickensheets
2,720,422 A 10/1955 Mercur
2,830,742 A 4/1958 Gibbons et al.
2,893,606 A 7/1959 Hawkins
2,960,260 A 11/1960 Kutik
3,017,056 A 1/1962 Bishop
3,022,779 A * 2/1962 Benkoe ..... 124/57
3,050,260 A 8/1962 Macrae et al.
3,229,859 A 1/1966 Conroy et al.
3,459,342 A * 8/1969 Manning ..... 222/402.13
3,485,206 A 12/1969 Smrt
3,510,028 A 5/1970 Batistelli
3,716,195 A 2/1973 Silva
3,856,209 A 12/1974 Hickson
3,861,566 A 1/1975 Wentzell
3,871,557 A 3/1975 Smrt
3,894,816 A 7/1975 Davis et al.
3,977,570 A 8/1976 Smrt
4,023,711 A 5/1977 Sena
4,092,000 A 5/1978 Offutt, III
4,099,482 A 7/1978 Smrt
4,262,821 A 4/1981 Smrt
D827,394 12/1986 Yamamato
4,660,745 A 4/1987 Hess, Jr.
4,789,084 A 12/1988 Yoshitomi
4,805,812 A 2/1989 Brody
4,886,191 A 12/1989 Yoshitomi
5,086,954 A 2/1992 Brody
D355,924 S 2/1995 Smrt
5,518,148 A 5/1996 Smrt
5,749,522 A 5/1998 Smrt
5,769,279 A * 6/1998 Smrt ..... 222/174
5,875,926 A 3/1999 Schwartz
6,053,260 A 4/2000 Boon et al.
6,390,336 B1 5/2002 Orozco (Continued)

*Primary Examiner* — Kevin P Shaver
*Assistant Examiner* — Daniel R Shearer
(74) *Attorney, Agent, or Firm* — Meroni & Meroni, P.C.; Charles F. Meroni, Jr.; Christopher J Scott

(57) ABSTRACT

An apparatus and trigger mechanism enables a user to ergonomically discharge aerosol container contents. The apparatus comprises a trigger unit, a handle assembly, a tension member, a tubular member, an operative end housing assembly, and an actuator assembly. The trigger unit interfaces the tension member to the handle assembly. The tension member transmits force from the trigger unit to the actuator assembly via the tubular structure, which structure interconnects the handle assembly and operative end housing. The operative end housing houses or receives the actuator assembly and an aerosol container. The transmitted force actuates the aerosol container via the actuator assembly. A method of assembling the apparatus is further described.

21 Claims, 18 Drawing Sheets

U.S. PATENT DOCUMENTS 6,435,129 B1 8/2002 McDonald et al.
6,450,423 B1 9/2002 Gurule
6,723,375 B2 4/2004 Zeck et al.
7,048,151 B1 5/2006 Wertz et al.
7,076,916 B2 7/2006 Bianchini
7,303,155 B2 * 12/2007 Kesti et al. ..... 239/578

* cited by examiner

—PRIOR ART—

—PRIOR ART—

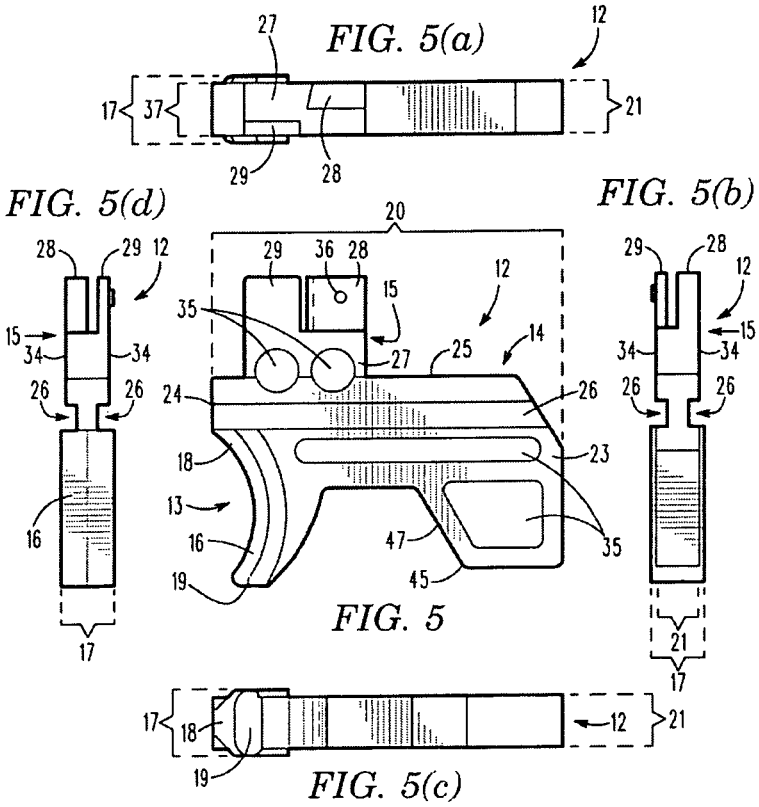
FIG. 5(a)
FIG. 5(b)
FIG. 5(d)
FIG. 5
FIG. 5(c)
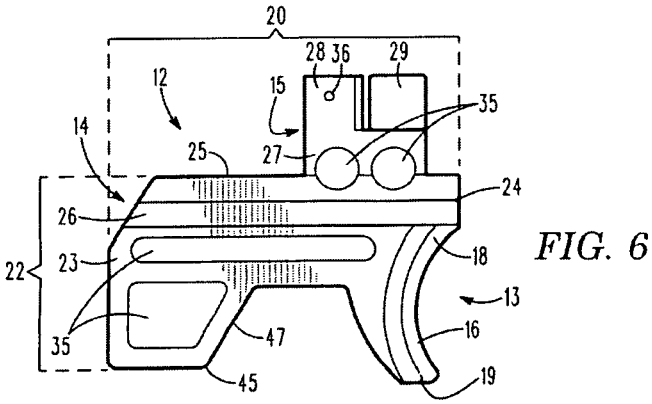
FIG. 6

—PRIOR ART—

TRIGGER MECHANISM FOR DISCHARGING AEROSOL CONTAINERS

BACKGROUND OF THE INVENTION

1. Field of the Invention

The present invention generally relates to an apparatus for discharging the contents of aerosol containers. More particularly, the present invention relates to an apparatus and trigger mechanism for enabling users to discharge aerosol container contents in a more economical, ergonomic, and labor-reduced manner.

2. Brief Description of the Prior Art

The use of aerosol containers for dispensing marking compositions is well-known, e.g., for striping construction sites, and for marking the location of utility lines. A number of devices have been developed which allow a person making marks using aerosol compositions to remain relatively upright, while at the same time positioning the container relatively close to the surface to be marked. These devices further allow the discharge of the aerosol container to be controlled by the user. Some of the more pertinent prior art relating to devices for discharging aerosol container contents and the like are briefly described hereinafter.

U.S. Pat. No. 3,485,206 ('206 Patent), which issued to Smrt, discloses a Marking Device. The '206 Patent describes a marking device for use with pressurized spray cans wherein the spray can is filled with a marking material and is equipped with a transversely movable valve which is operable to release the marking material when the valve is pointed in a generally downward direction. The spray can is reasonably mounted adjacent one end of an elongated holder, and a bell crank is pivotally mounted on the holder adjacent the valve. A link connects one of the lever arms of the bell crank to the valve, and a valve actuator extends from the other lever are toward the other end of the holder. The other end of the holder may be equipped with a handle, and longitudinal movement of the valve actuator produces transverse movement of the link and operates the valve.

U.S. Pat. No. 3,716,195 ('195 Patent), which issued to Silva, discloses an Extension Hand Sprayer Device. The '195 Patent describes an extension hand sprayer device for spraying a line on the pavement while standing erect which includes a spray can holder, an extension arm secured thereto and extending a substantial distance therefrom terminating in a handle. A push button mounted for sliding movement on the arm is connected to a member which is adapted to press against the push button of the spray can when actuated by thumb pressure on the push button mounted on the arm.

U.S. Pat. No. 3,977,579 ('570 Patent), which issued to Smrt, discloses a Spraying Apparatus. The '579 Patent describes an apparatus for spraying the contents of aerosol spray cans includes a pair of telescopingly related housings so that the length of the apparatus can be varied as desired. The aerosol can is mounted on one end of one of the housings, and a handle is provided on the opposite end of the other housing. The valve of the aerosol can is operated by a pair of actuator rods which are telescopingly engaged within the housings, and a latch releasably locks the actuator rods in the desired position.

U.S. Pat. No. 4,092,000 ('000 Patent), which issued to Offutt, III, discloses an Extension Spry Device. The '000 Patent describes an extension spray device for aerosol cans having a crimped-cap closure comprises a can holder that grips the periphery of the closure cap, a spray member to engage the can control valve stem and convey fluid from the can to a lateral spray nozzle, an extension tube connecting a remote handle to the aerosol can holder, a wedge to force the spray member against the valve stem to dispense fluid from the can and a line attached to the wedge carried within the extension tube to move the wedge from the handle. The extension tube connection to the can holder can be moveable so that the spray can angle can be varied relative to the extension tube and handle.

U.S. Pat. No. 4,805,812 ('812 Patent), which issued to Brody, discloses a Spray Can Actuation Device. The '812 Patent describes a spray can holding and actuating device includes a body that is removably attachable to the top of a spray can. The body includes a handle and a valve actuation lever, operated by a trigger that engages the push-button valve of the spray can when the trigger is pressed. A locking plate is pivotally attached to the front of the body for movement between an unlocked position and a locked position. In the unlocked position, the actuation lever has an unobstructed path for engagement with the valve. When the plate is in the locked position, it locks the actuation lever in a position disengaged from the valve. A trigger lock is advantageously provided selectively to disable the trigger. The trigger lock includes a pin movable between an unlocked position, in which it is received in an orifice in the body when the trigger is pressed, and a locked position, in which the pin engages the body before the trigger is moved sufficiently to bring the actuation lever into operable engagement with the valve.

U.S. Pat. No. 5,518,148 ('148 Patent), which issued to Smrt, discloses a Handle for Holding and Remotely Actuating an Aerosol Container. The '148 Patent describes a spraying apparatus for discharging the contents of a valve-equipped aerosol can comprising: an elongated, hollow tube having a front and rear end; a front housing fixed to the tube at the front end, the front housing including a can holder comprising a hollow cylinder sized to receive an aerosol can; a bell crank pivotally mounted in the front housing; a trigger rod fixed to a first arm of the bell crank, an actuator rod fixed to a second arm of the bell crank and mounted within the first housing for longitudinal movement between a discharging position, and a non-discharging position; a biasing spring fixed between the trigger rod and a retaining wall in the front housing; a rear housing mounted to the rear end of the tube the rear housing including a grip portion; a trigger disposed within the rear housing and connected to the trigger rod for reciprocating horizontal movement between a discharging position and a non-discharging position; and a locking land disposed within the rear housing for frictionally receiving a front surface of the trigger when it is moved vertically from the discharging position, the biasing spring biasing the trigger into engagement with the locking land and thus maintaining the trigger in the discharging position.

U.S. Pat. No. 5,875,926 ('926 Patent), which issued to Schwartz, discloses a Cylindrical Barrel, Linear, Slide Trigger. The '926 Patent describes a slide trigger for a liquid delivery system has a handle and a retractable trigger assembly. The handle has a grip portion and a barrel portion with a guide. The trigger assembly has a slide which travels freely within the guide and a trigger portion attached to the slide which activates the liquid delivery system when the trigger portion is retracted.

U.S. Pat. No. 6,390,336 ('336 Patent), which issued to Orozco, discloses a Spray Wand with Stand. The '336 Patent describes a spray wand and stand in which a canister holder is adjacent a bottom portion of an elongated framework. A stand is situated adjacent the canister holder and provide ground contact points with the framework that function to hold the framework in a position in which a handle end of the framework is elevationally above the canister holder.

U.S. Pat. No. 7,048,151 ('151 Patent), which issued to Wertz et al., discloses an Aerosol Can Holding and Operating Device. The '151 Patent describes a device comprising an elongated pole having a bottom end and a top end. The top end is open and an aperture extends into an interior of the pole. A notch extends into the top end such that a lip is defined that is spaced from the top end. The aperture is positioned nearer the bottom end than the top end. An elongated tether extends through the aperture and outwardly through the top end. An attaching member is attached to the pole for selectively attaching an aerosol can to the pole when the aerosol can is positioned on the lip. The tether is removably coupled to an actuator of the aerosol can for selectively dispensing contents of the aerosol can.

U.S. Pat. No. D355,824 ('824 Patent), which issued to Smrt, describes and illustrates an ornamental design of a handle for holding and remotely actuating an aerosol container.

From a consideration of the foregoing, it will be noted that the prior art perceives a need for a apparatus and trigger mechanism for enabling users to discharge aerosol containers in a more economical, ergonomic and labor-reduced manner so as to primarily minimize manufacturing and purchase costs as well as bodily stress during use. The prior art thus perceives a need for such an apparatus and trigger mechanism.

SUMMARY OF THE INVENTION

The achieve these and other readily apparent objectives, the present invention essentially discloses an apparatus for discharging aerosol container contents. The apparatus is thought to be essentially defined by an apparatus for enabling a user to ergonomically discharge aerosol container contents, which apparatus comprises a trigger unit, a handle assembly, a tension member, a tubular member, an operative end housing, and an actuator assembly.

The trigger unit is believed to essentially comprise a finger-engaging portion, a trigger-guiding portion, and a member-receiving portion. The trigger-guiding portion comprises certain trigger-based stop structure and handle-receiving grooves opposedly extending into the width of said trigger-guiding portion. The member-receiving portion comprises an apertured upright.

The handle assembly essentially comprises opposed guide flanges, handle-based stop structure, and a first tube-interfacing portion. The handle-receiving grooves of the trigger unit receive the guide flanges of the handle assembly and are bidirectionally displaceable therealong. The trigger-based and handle-based stop structure(s) prevent excess bidirectional movement of the trigger unit within the handle assembly. The tension member as preferably defined by a relatively thin gauge wire element comprises first and second tension member ends and a member length extending therebetween. The first tension member end is received by an aperture formed in the apertured upright of the trigger unit.

The tubular member has first and second tube ends and a tube length extending therebetween. The first tube-interfacing portion of the handle assembly interfaces with the first tube end, and the member length of the tension member is received by the tube length. The operative end housing comprises a second tube-interfacing portion, a container-receiving portion, and an actuator-receiving portion.

The actuator-receiving portion has a post structure and spring stop structure. The container-receiving and actuator-receiving portions are separated by a common apertured wall. The actuator assembly comprises an apertured crank element, a spring assembly, and an actuator element. The spring assembly has first and second spring ends, and the actuator element has first and second actuator ends.

A first aperture formed in the crank element rotatably receives the post structure; a second aperture formed in the crank element receives the first spring end; a third aperture formed in the crank element receives the first actuator end; and a fourth aperture formed in the crank element receives the second tension member end.

The spring stop structure prevents movement of the second spring end, and the actuator member extends through the apertured wall such that the second actuator end is displaceable within certain space defined by the container-receiving portion. The container-receiving portion is sized and shaped to receive an aerosol container.

The trigger unit receives a manually (finger-initiated) pull force for selectively displacing the tension member in a first (rearward) direction thereby transmitting force to the rotatable crank element as biased by the spring assembly for rotating the crank element and displacing the second actuator end for actuating (a nozzle of) the aerosol container as received by the operative end housing.

The trigger mechanism according to the present invention may be said to essentially comprise a (molded) trigger unit, a tension member, and a handle assembly. The molded trigger unit comprises a finger-engaging portion, a trigger-guiding portion, and a (tension) member-receiving portion.

The finger-engaging portion comprises a finger-engaging (saddle-shaped) surface, a (maximum) trigger width, a top trigger terminus, and a bottom trigger terminus. The trigger-guiding portion comprises a guide length, a guide width, a guide height, guide stop structure, a guide top, and handle-receiving grooves (or channels) opposedly extending into the guide width. The member-receiving portion comprises a base portion, an apertured upright, and a member-guiding upright.

In function, the finger-engaging surface ergonomically receives a user's finger. The handle-receiving grooves receive the opposed guide flanges of a handle assembly, and the guide stop structure prevents excess forward and rearward movement of the molded trigger unit. The apertured upright receives a first end of a tension member, and the member-guiding upright prevents the tension member from becoming removed from the apertured upright.

In addition to the foregoing structural considerations, it is further believed that the inventive concepts discussed support certain new methods and/or processes for assembling the apparatus and/or trigger mechanism. In this regard, it is contemplated that the detailed specifications support a certain apparatus assembly process wherein the steps may be said to include placing a first handle half in a first template-based cavity and placing a first housing section in a second template-based cavity whereafter the first handle half and first housing section may be interconnected via a tubular structure.

A tension member may, at some point in the process be inserted through the tubular structure, and a trigger or trigger unit may be interconnected with a first tension member end of the tension member. The interconnected trigger and first tension member end may thus be placed into the first handle half. Similarly, an actuator assembly may be interconnected with a second tension member end of the tension member, and the interconnected second tension member and actuator assembly may be placed into the first housing section.

After internal parts are assembled (and properly and precisely positioned via the template), a second handle half may be placed on the first handle half, and a second housing section may be placed on the first housing section. Fasteners such as rivets may then be simultaneously engaged so as to fasten the second handle half to the first handle half and the second housing section to the first housing section thereby further fastening the handle assembly and operative end housing assembly to the other noted components to render a fully assembled apparatus for discharging aerosol container contents.

BRIEF DESCRIPTION OF THE DRAWINGS

Other features of my invention will become more evident from a consideration of the following brief description of patent drawings:

FIG. 5 is a plan view of the left side of the trigger unit according to the present invention showing a forward finger-engaging portion, a rearward handle-engaging portion, and an upper tension member-receiving or coupling portion.

FIG. 5(*a*) is a top plan view of the trigger unit otherwise depicted in FIG. 5 showing top portions of the rearward handle-engaging portion and the upper tension member-receiving or coupling portion.

FIG. 5(*b*) is a rear plan view of the trigger unit otherwise depicted in FIG. 5 showing rear portions of the rearward handle-engaging portion and the upper tension member-receiving or coupling portion.

FIG. 5(*c*) is a bottom plan view of the trigger unit otherwise depicted in FIG. 5 showing bottom portions of the rearward handle-engaging portion and the forward finger-engaging portion.

FIG. 5(*d*) is a front plan view of the trigger unit otherwise depicted in FIG. 5 showing frontal portions of the forward finger-engaging portion and the upper tension member-receiving or coupling portion.

FIG. 6 is a plan view of the left side of the trigger unit according to the present invention showing a forward finger-engaging portion, a rearward handle-engaging portion, and an upper tension member-receiving or coupling portion.

FIG. 8(*a*) is a fragmentary end view depiction of the upper tension member-receiving or coupling portion receiving or coupling with the tension member or trigger wire according to the present invention.

FIG. 8(*b*) is a fragmentary left side view depiction of the upper tension member-receiving or coupling portion receiving or coupling with the tension member or trigger wire according to the present invention and depicting the tension member being rotated about an axis of rotation extending through an aperture formed in an apertured upright of the upper tension member-receiving or coupling portion.

FIG. 12(*a*) is a fragmentary diagrammatic type depiction of an actuator according to the present invention about to actuate a nozzle of an aerosol container, which nozzle is depicted form an axial vantage point.

FIG. 12(*b*) is a fragmentary diagrammatic type depiction of the actuator according to the present invention about to actuate a nozzle of an aerosol container, which nozzle is depicted form a side view.

FIG. 12(*c*) is a fragmentary diagrammatic type depiction of the actuator according to the present invention actuating a nozzle of an aerosol container, which nozzle and aerosol container contents release being depicted form a side view.

FIG. 22(*a*) is a reduced side view depiction of the spring assembly otherwise depicted in FIG. 21 interconnected with the crank element otherwise depicted in FIG. 22.

FIG. 28(*a*) is a fragmentary enlarged sectional view as sectioned from FIG. 28 depicting the second handle half being fastened to the first handle half with parts broken away to show inner fastener-engaging press posts for press-fitting the rivets to the first handle half so as to finally fasten the first and second handles halves to one another.

FIG. 28(*b*) is a fragmentary enlarged sectional view as sectioned from FIG. 28(*a*) depicting an upper end of the fastener-engaging press post for press-fitting a rivet end to the first handle half.

DETAILED DESCRIPTION OF THE PREFERRED EMBODIMENT

Figure 1:
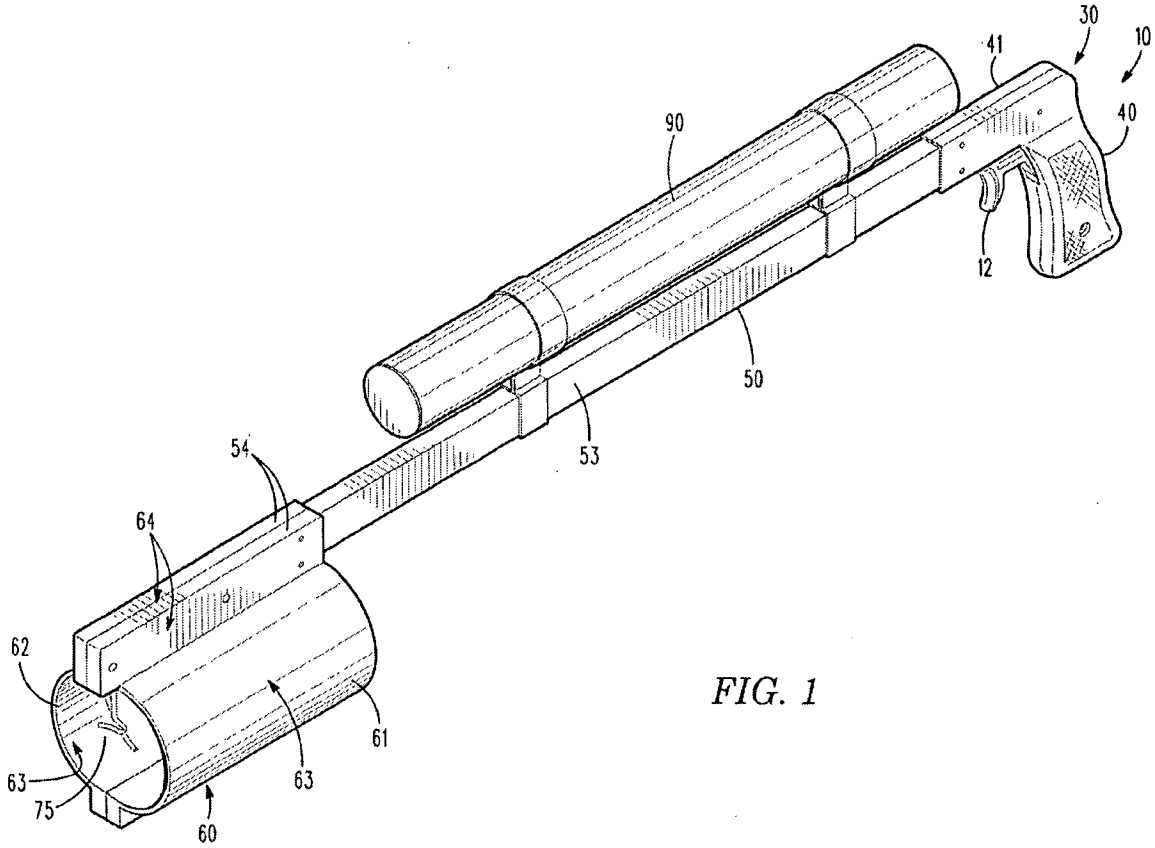
FIG. 1 is a top perspective view of an assembled aerosol container discharging apparatus according to the present invention outfitted with a state of the art flag or stake holder or container.
Figure 2:
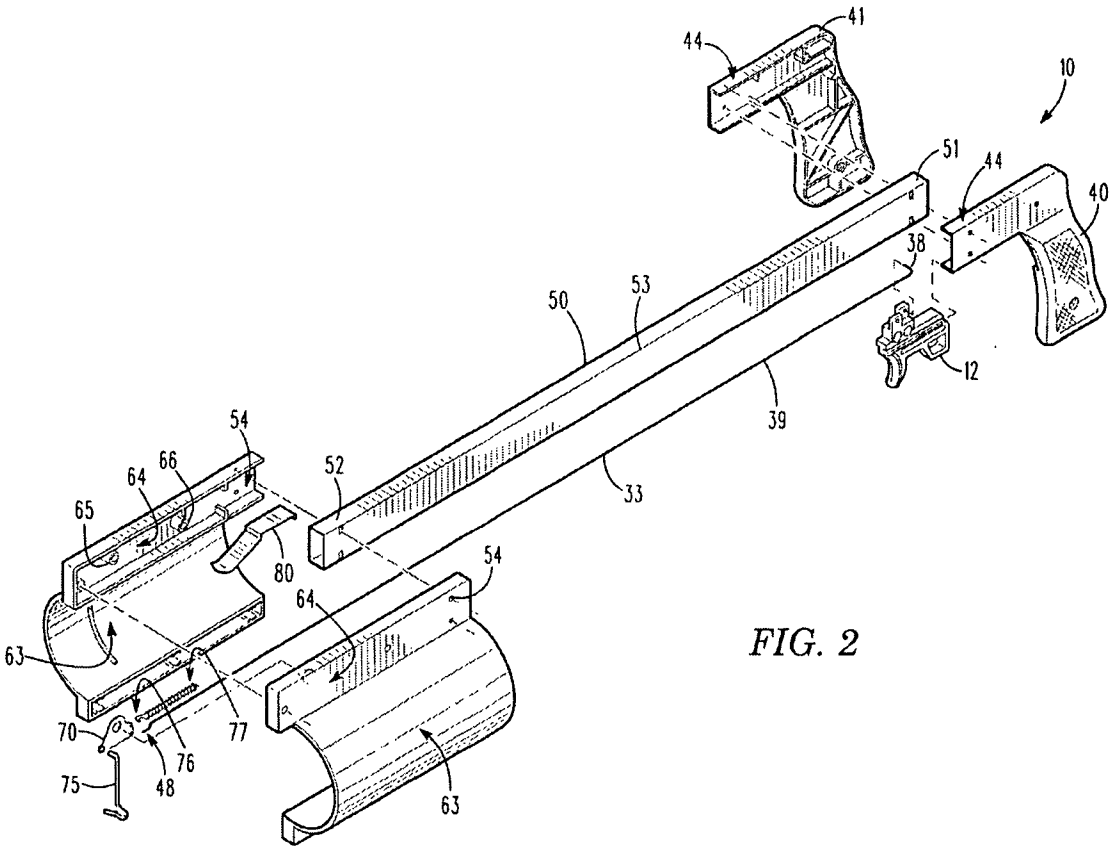
FIG. 2 is a top perspective view of an exploded aerosol container discharging apparatus according to the present invention.

Referring now to the drawings with more specificity, the preferred embodiment of the present invention concerns an apparatus 10 for discharging the contents of an aerosol container 11 for the exemplary purpose of marking underling media with paint. The aerosol container-discharging apparatus 10 incorporates a specially designed trigger unit 12 interconnected or interconnnectable with a separate and relatively slim gauge trigger wire (as at 33) for enabling a user to ergonomically discharge aerosol container contents. The apparatus 10 is preferably assembled by way of special methodology so as to effect high speed assembly with low cost components to render a less costly, yet improved aerosol container contents-discharging apparatus 10 as described in more detail hereinafter.

Figure 3:
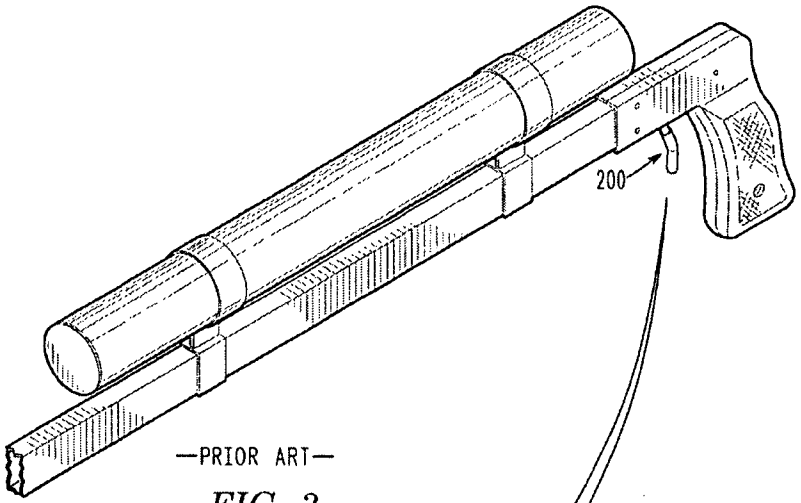
FIG. 3 is a fragmentary top perspective view of an assembled prior art aerosol container discharging apparatus outfitted with a prior art flag or stake holder or container.
Figure 4:
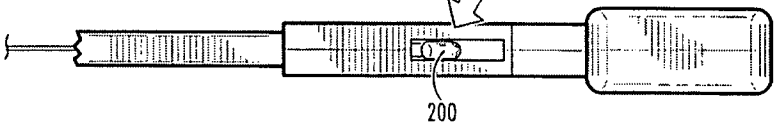
FIG. 4 is a fragmentary bottom plan view of the assembled prior art aerosol container discharging apparatus otherwise depicted in FIG. 3 shown to draw attention to the prior art trigger mechanism upon which the present invention attempts to improve.
Figure 7:
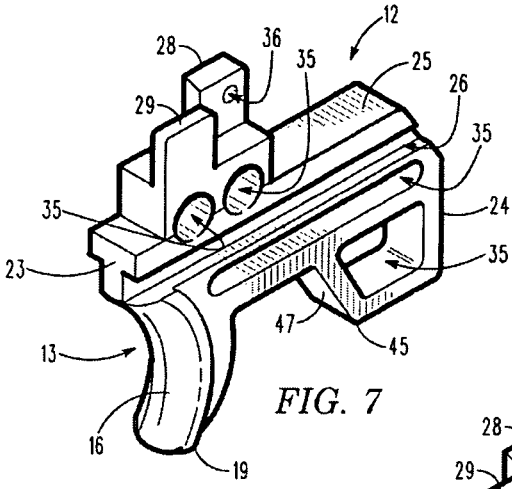
FIG. 7 is a top left perspective view of the trigger unit according to the present invention showing the forward finger-engaging portion, the rearward handle-engaging portion, and the upper tension member-receiving or coupling portion.
Figure 8:
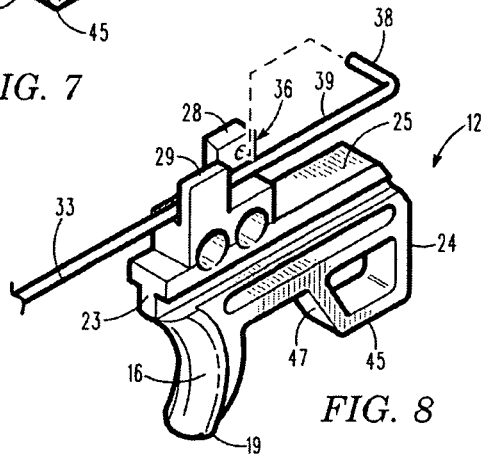
FIG. 8 is a top left perspective view of the trigger unit according to the present invention showing the upper tension member-receiving or coupling portion exploded from a tension member or trigger wire according to the present invention.
Figure 8A:
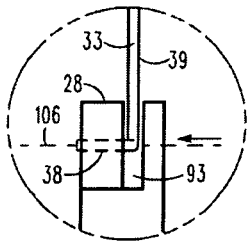
Figure 8B:
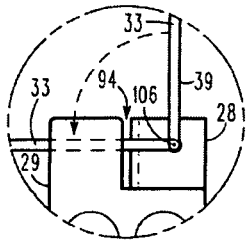
Figure 9:
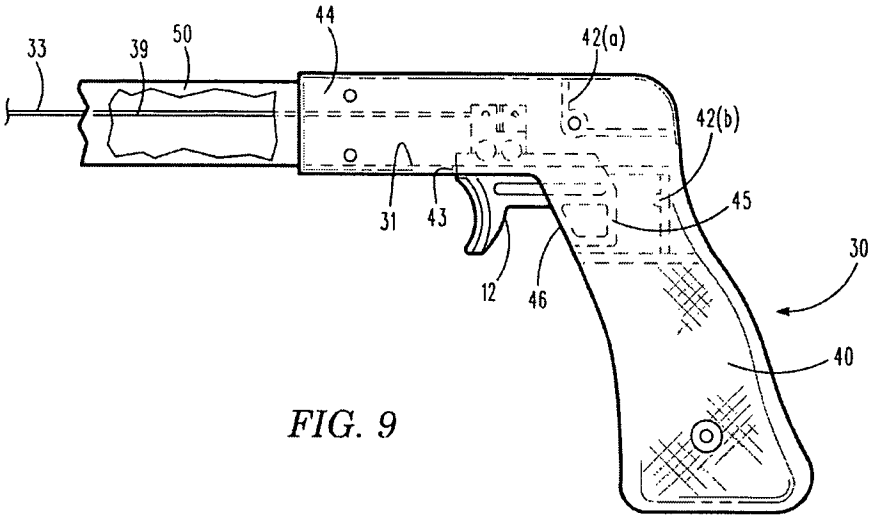
FIG. 9 is a fragmentary left side plan view of the handle end of the assembled aerosol container discharging apparatus according to the present invention with parts of the tubular structure broken away to show the tension member and internal portions of the handle assembly shown in phantom to show stop structure for limiting movement of the trigger unit.

A significant disadvantage with prior art apparatuses for discharging aerosol container contents is the type of trigger mechanism generally referenced at 200 in FIGS. 3 and 4. Commonly, a single, relatively heavy gauge wire is utilized to transfer forces from the trigger site to the actuator site, which heavy gauge wire is bent at the trigger end so as to effect or resemble a trigger as at 200. The relatively heavy gauge wire required to withstand the pulling forces, however, contributes both to added weight of the prior art apparatus and irritation of the user's trigger finger(s) with continual use since the wire diameter is not ergonomically correct to the palm side surface of one's (trigger) finger, regardless of whether the wire is outfitted with a finger-protective rubber sleeve.

To overcome these disadvantages, the trigger mechanism according to the present invention preferably comprises a uniquely configured, molded trigger unit 12 constructed from relatively low cost and lightweight polymeric material. Further, the trigger unit 12 comprises a single-finger-engaging portion as at 13, a trigger-guiding portion or handle-engaging portion as at 14, and a tension member-receiving or coupling portion as at 15. The molded trigger unit 12 preferably further comprises cavities 35 for minimizing structural bulk of the unit 12.

The finger-engaging portion 13 preferably comprises a saddle-shaped, finger-engaging surface as at 16 so as to minimize finger discomfort with continual usage; a maximum trigger width as at 17; a top trigger terminus as at 18; and a bottom trigger terminus as at 19. It will be noted from a general and comparative inspection of FIGS. 5, 5(*d*), 6, 7, 8, and 9-11 that the saddle-shaped surface is designed to as to follow the form and function of the palm side of a user's trigger finger 100.

The trigger-guiding or handle-engaging portion 14 preferably comprises a guide length as at 20, a guide width as at 21, a guide height as at 22, first or rearward stop structure as at 23, second or forward stop structure as at 24, a guide top as at 25, and handle-receiving grooves (or channels) as at 26, which channels or grooves 26 opposedly extend into the guide width 21.

It should be noted that the trigger width 17 is greater than the guide width 21 so as to enhance trigger finger comfort. In this regard, it is noted that increased surface area of a contact surface spreads force of a larger area, and thus the pressure at any given pressure point is generally reduced. Further, the guide top 25 is substantially planar and the handle-receiving grooves or channels 26 are formed parallel to the guide top 25 along the entire guide length 20.

The (tension) member-receiving portion 15 preferably comprises a base portion as at 27, an apertured upright as at 28, and a (tension or wire) member-guiding upright as at 29. The apertured upright 28 and the member-guiding upright 29 are coplanar with opposed portions 34 of base portion 27, which base portion 27 preferably has a base width 37 equal to the guide width 21. The apertured upright 28 and the member-guiding upright 29 are preferably parallel to one another and the member-guiding upright 29 is preferably formed forward of the apertured upright 28. The apertured upright 28 preferably comprises an aperture 36 formed orthogonal relative to the guide length 20 or plane of the aperture upright 28.

Figure 10:
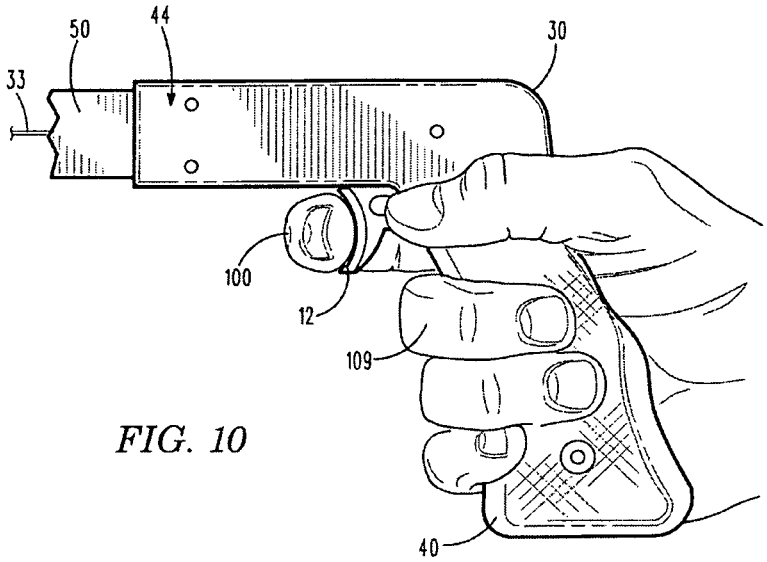
FIG. 10 is a fragmentary left side plan view of the handle end of the assembled aerosol container discharging apparatus according to the present invention showing a right hand handling the handle assembly and trigger unit before displacing the trigger unit in a rearward direction.
Figure 11:
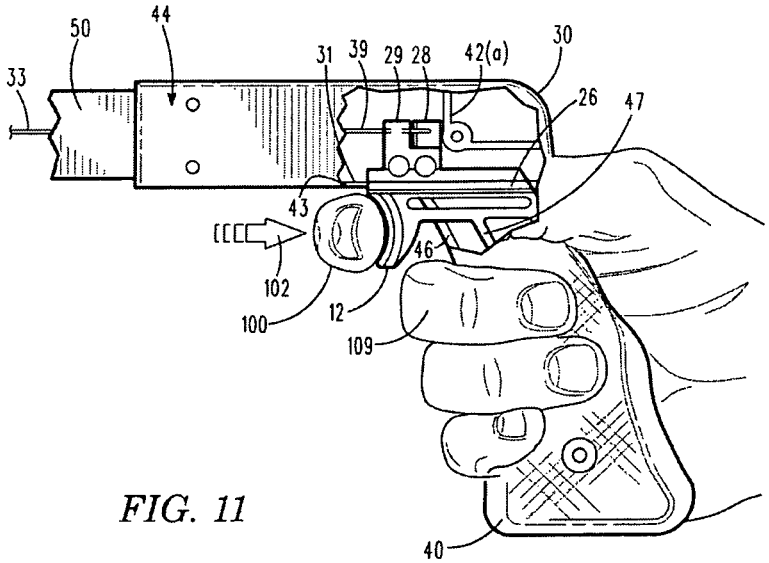
FIG. 11 is a fragmentary left side plan view of the handle end of the assembled aerosol container discharging apparatus according to the present invention with parts of the handle assembly broken away to show internal structures and showing a right hand handling the handle assembly and trigger unit after displacing the trigger unit in a rearward direction.
Figure 12:
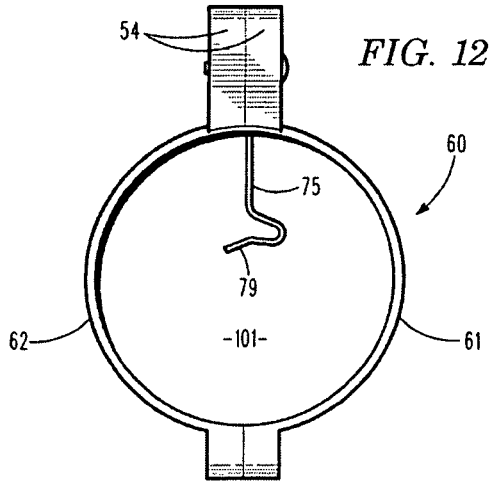
FIG. 12 is an end view of the container-receiving operative end of the assembled aerosol container discharging apparatus according to the present invention.
Figure 12A:
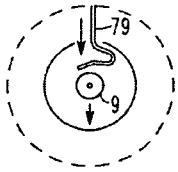
Figure 12B:
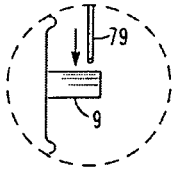
Figure 12C:
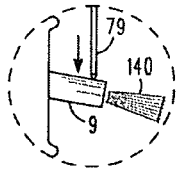
Figure 13:
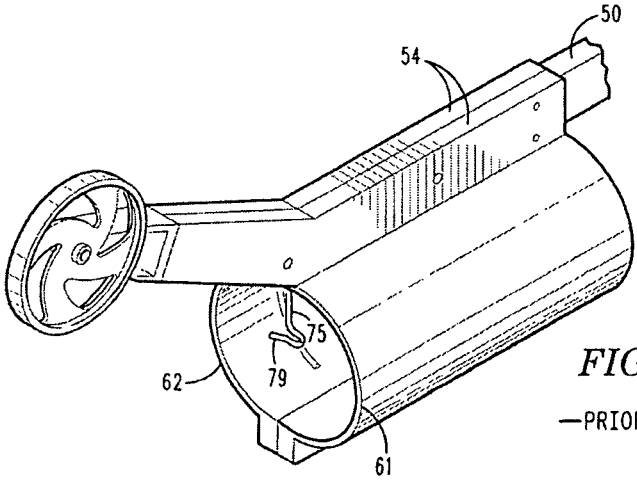
FIG. 13 is a fragmentary top perspective view of an optional container-receiving operative end of the assembled aerosol container discharging apparatus according to the present invention showing a wheel structure for enabling a user to roll said operative end upon a support surface adjacent a cord-like member.
Figure 15:
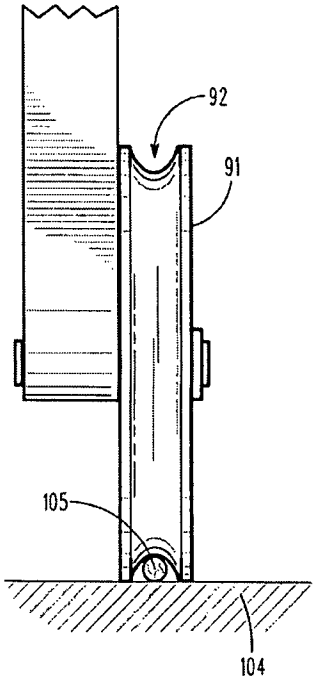
FIG. 15 is a fragmentary end view depiction of the grooved-rim wheel structure otherwise depicted in FIG. 14 showing the grooved wheel structure rolling upon a support surface while receiving a cord-like member within a grooved-rim of the wheel structure.
Figure 14:
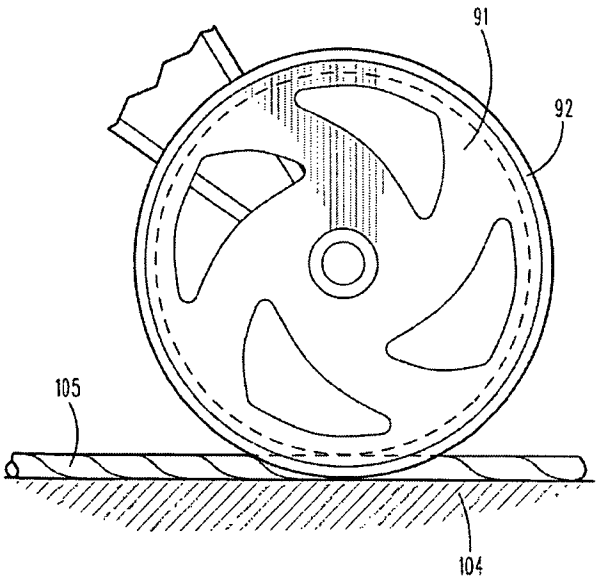
FIG. 14 is a fragmentary side elevational depiction of a grooved-rim wheel structure showing the grooved-rim wheel structure rolling upon a support surface while receiving a cord-like member within a grooved-rim of the wheel structure.
Figure 17:
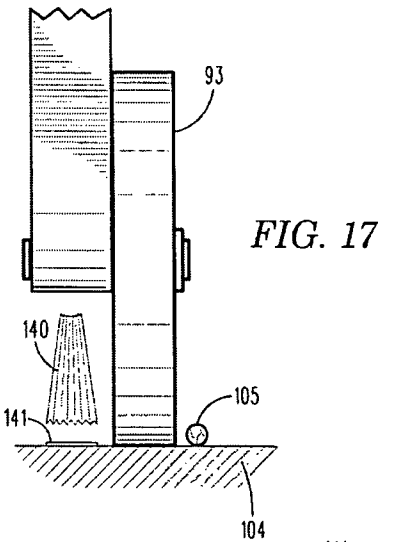
FIG. 17 is a fragmentary end view depiction of the flat rim wheel structure otherwise depicted in FIG. 16 showing the flat rim wheel structure rolling upon the support surface adjacent or next to a cord-like member.
Figure 16:
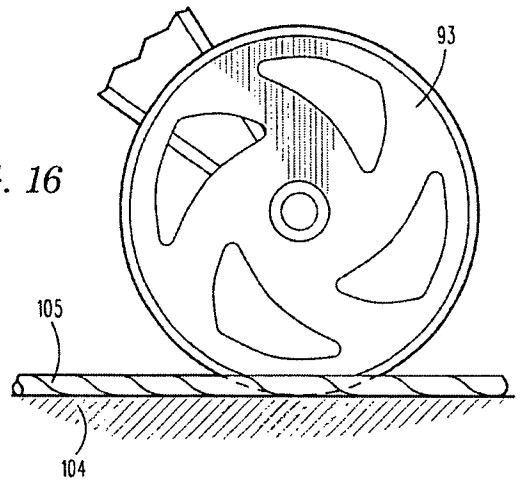
FIG. 16 is a fragmentary side elevational depiction of a flat rim wheel structure showing the wheel structure rolling upon a support surface adjacent or behind a cord-like member.
Figure 18:
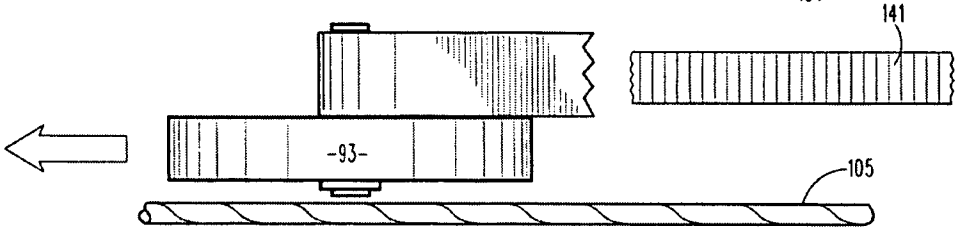
FIG. 18 is a fragmentary top plan view of the wheel structure otherwise depicted in FIG. 17 showing the wheel structure rolling upon the support surface adjacent the cord-like member for enabling the user to release container contents from an aerosol container as received in the container-receiving operative end of the assembled aerosol container discharging apparatus so as to mark the support surface adjacent the guiding cord-like member.

As previously stated, the finger-engaging surface 16 is designed to comfortably and ergonomically receiving the contour of a user's finger as generally depicted in FIGS. 10 and 11. The handle-receiving grooves 26 are designed to receive opposed guide flanges 31 of the handle assembly 30, the rearward and forward stop structure(s) 23 and 24 of the trigger unit are designed to prevent excess rearward and forward movement of the molded trigger unit 12 in conjunction with cooperable stop structure of the handle assembly 30. The apertured upright 28 is designed to receive a first member end 32 of the tension or wire member 33, and the member-guiding upright 29 is designed to prevent the tension member 33 from becoming removed from the apertured upright 28 after inserted therein.

As indicated, a wire or similar other tension member 33 is interconnected to the member-receiving portion 15 and thus may be said to be further incorporated into the trigger mechanism. In this regard, it will be noted that the tension member 33 preferably comprises an L-shaped first tension member end 32 such that the short arm of the L-shaped end 32 is inserted through the aperture 36. The first tension member end 32 of the tension member 33 is thus preferably L-shaped and has an upright-engaging portion 38 and an outwardly extending portion 39 formed orthogonal relative to the upright-engaging portion 38, which portion 38 is received by the aperture 36. The member-guiding upright 29 prevents lateral movement of the outwardly extending portion 39 insofar as the outwardly extending portion 39 is rotated into position laterally adjacent the member-guiding upright 29.

The handle assembly 30 is preferably constructed (molded) from low cost and lightweight polymeric material and comprises a first handle half as at 40; a second handle half as at 41; opposed guide flanges as at 31 (one flange 31 being formed on each of the halves 40 and 41); rearward guide stop structures as at 42(*a*) and 42(*b*); forward guide stop structure as at 43; and a first tube-interfacing portion as at 44 formed on each of the halves 40 and 41. The handle-receiving grooves 26 of the trigger unit 12 receive the guide flanges 31 and are bidirectionally displaceable therealong in forward/rearward direction(s).

The guide stop structures 42(*a*), 42(*b*), and 43 function in cooperation with the rearward and forward stop structures 23 and 24 to prevent excess bidirectional movement of the trigger unit 12. In other words, the rear and forward stop structures 23 and 24 cooperably interact with the guide stop structures 42(*a*), 42(*b*), and 43 to prevent excess forward and rearward movement of the molded trigger unit 12.

The trigger-guiding portion 14 further preferably comprises a right trapezoidal portion as at 45 and the handle assembly 30 comprises an angled portion 46 opposite the bottom trigger terminus 19 when the trigger unit 12 and handle assembly 30 are assembled. The trapezoidal portion 45 has an angled first side 47, which first side 47 is substantially coplanar with the angled portion 46 when the forward stop structure 24 cooperably interacts with the guide stop structure 43 for preventing excess forward movement of the molded trigger unit 12. The trigger unit 12 further comprises spacing intermediate the bottom trigger terminus 19 and the angled first side 47. The spacing is preferably sized and shaped to receive a user's uppermost non-trigger finger (as at 109) when the rearward stop structure 23 cooperably interacts with the guide stop structures 42(*a*) and 42(*b*) for preventing excess rearward movement of the molded trigger unit 12.

The apparatus 10 further comprises a tubular structure 50 preferably constructed from a relatively rigid, lost cost material, which tubular structure 50 comprises a first tube end 51, a second tube end 52, and a tube length 53 extending therebetween. The first tube-interfacing portion(s) 44 interface with the first tube end 51 and the member length 39 of the tension member 33 is inserted through or otherwise received by the tube length 53. The second tube end 52 interfaces with second tube-interfacing portion(s) 54 formed in each half of an operative end housing assembly 60.

The operative end housing assembly 60 is preferably constructed (molded) from low cost and lightweight polymeric material and comprises a first housing section 61, a second housing section 62, the second tube-interfacing portion(s) 54 formed in each of the sections 61 and 62; first and second container-receiving portion(s) 63 (formed in each of the sections 61 and 62), and first and second actuator-receiving portion(s) as at 64 (formed in each of the sections 61 and 62). The actuator-receiving portion(s) 64 each have post structure 65 and spring stop structure 66. The container-receiving portions 63 and actuator receiving portions 64 are separated by a common apertured wall 67 in which a wall aperture is referenced at 68.

The apparatus 10 further preferably comprises an actuator assembly having a number of elements including a bell-shaped and apertured crank element 70, a spring assembly (comprising a compression spring 97 and a spring post 98), and an actuator element 75. The spring assembly has a first spring end 76 and a second spring end 77, and the actuator element 75 has a first actuator end 78 and a second actuator end 79. A first aperture 71 formed in the crank element 70 rotatably receives the post structure 65. A second aperture 72 formed in the crank element 70 receives the first spring end 76; a third aperture 73 formed in the crank element 70 receives the first actuator end 78; and a fourth aperture 74 formed in the crank element 70 receives a second tension member end 48 of the tension member 33.

When in an assembled state, the spring stop structure 66 of the operative end housing assembly 60 is designed to prevent movement of the second spring end 77. The actuator member 75 extends through the aperture 68 of the apertured wall 67 such that the second actuator end 79 is displaceable orthogonally relative to the axis of the housing assembly 60 within space 101 defined by the container-receiving portion(s) 63. The container-receiving portion(s) 63 are sized and shaped to receive an aerosol container 11 as generally depicted in FIG. 25.

The apparatus 10 may further preferably comprise certain retention means for retaining the aerosol container 11 within the container-receiving portion(s) 63, which retention means are further contemplated to preferably be defined by or comprise certain spring means for biasing the aerosol container 11 against a wall of the container-receiving portion(s) 63. In this regard, a small spring element or container tension spring 80 may be outfitted between the tubular structure 50 and the sections 61 and 62 so that when an aerosol container 11 is received by the container-receiving portion(s) 63, the spring element 80 will retain the container 11 within the portion(s) 63 by pressing the same against the wall of the operative end housing assembly 60.

Figure 25:
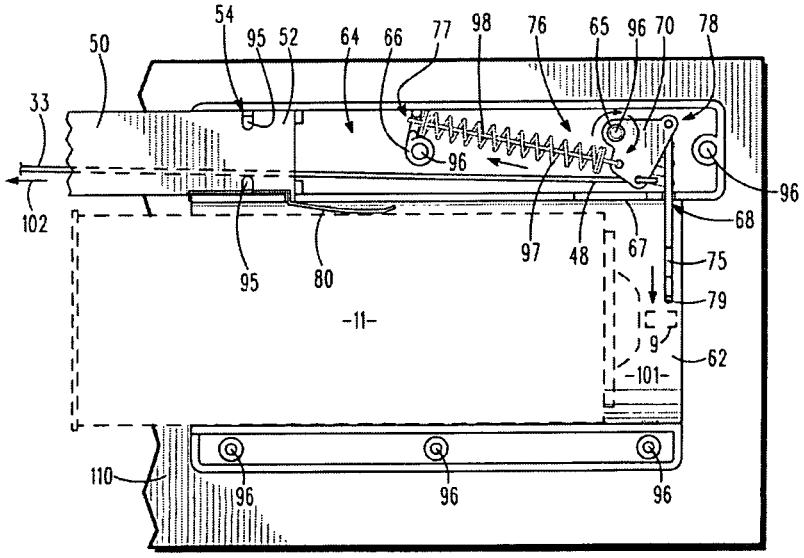
FIG. 25 is an enlarged top plan view of the container-receiving operative end (with a second housing section removed) of the aerosol container discharging apparatus according to the present invention showing a phantom container received in the container-receiving portion and showing vector arrows to depict anticipated movement of the otherwise relaxed actuator assembly.
Figure 26:
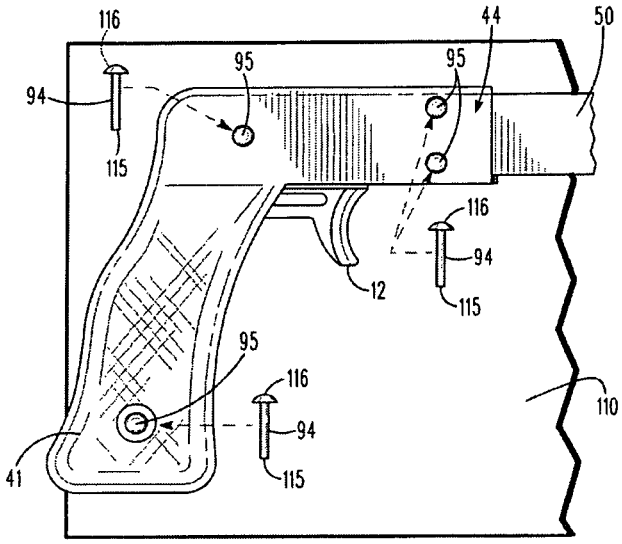
FIG. 26 is an enlarged top plan view of the handle end of the aerosol container discharging apparatus according to the present invention showing a second handle half placed on top of the first handle half otherwise depicted in FIG. 23 and showing rivets exploded from the handle end.
Figure 27:
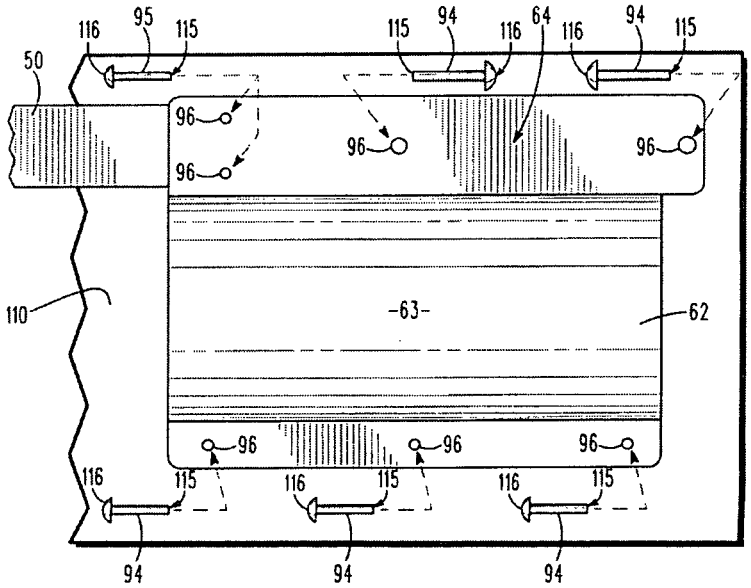
FIG. 27 is an enlarged top plan view of the container-receiving operative end of the aerosol container discharging apparatus according to the present invention showing a second housing section placed on top of the first housing section otherwise depicted in FIG. 23 and showing rivets exploded from the container-receiving operative end.

The trigger unit 12 is thus designed to receive a manual (i.e. finger-initiated) pull force as at vector arrow 102, which pull force 102 displaces the trigger unit 12 rearward and thereby selectively displaces the tension member 33 in a first (rearward) direction thereby transmitting force 102 to the rotatable crank element 70 as biased by the spring assembly for rotating the crank element 70 about the post structure 65 and displacing the second actuator end 79 for actuating (a nozzle 9 of) the aerosol container 11 as received within the container-receiving portion(s) 63 as generally depicted in FIG. 25.

The apparatus 10 may further comprise certain implement-holding means as may be defined, for example, by a flag or stake container 90. Flag or stake containers such as the one referenced at 90 are commonly employed by user's of the types of aerosol-discharging apparatuses. Thus the implement-holding means as exemplified the flag or stake container 90 are believed to be useful when used in combination with the apparatus 10 according to the present invention. It is thus contemplated that the implement-holding means may be fastened to a portion (e.g. the tubular structure 50) of the apparatus 10 for holding implements such as flags or stakes usable in combination with said aerosol container discharging apparatus 10.

Oftentimes a length of cord 105 may be placed upon a surface 104 to be marked for aiding the user to mark the surface 104. In this regard, it is contemplated that the operative end housing assembly 60 may be further outfitted with or comprise certain roller means for movement for enabling a user to roll the apparatus 10 upon a surface 104 to be treated with the aerosol container 11. The roller means for movement may be preferably defined by a wheel structure. From a comparative inspection of FIGS. 13-18, it will be seen that the wheel structure may be a grooved-rim wheel structure as at 91 or a flat-rim wheel structure as at 93.

The grooved-rim wheel structure 91 preferably comprises a grooved rim as at 92. The grooved rim 92 has a depth sufficient to receive a cord 150 (i.e. the diameter thereof) and thus may well function to receive a cord length 105 while enabling the user to roll the apparatus 10 upon the surface 104 to be marked. It is to be understood that users of paint wands or apparatuses designed to mark surfaces by way of dispensing aerosol container contents often used cords or cord-like members 105 to guide the marking process. In this regard, it is contemplated that the apparatus 10 may be outfitted with a wheel structure or similar other roller means for movement so that the user can mark the surface 104 with paint as at 140 (or similar other aerosol container contents), which paint marking 141 is depicted with pink hatch marking(s) in FIG. 18.

The apparatus 10 according to the present invention is believed best constructed or assembled according to certain methodology incorporating the use of a template formed to enable the assembly person to quickly and efficiently assemble the apparatus 10. In this regard, the reader is first directed to FIG. 19, which figure depicts a template or assembly fixture 110 having detent cavities or moldings formed therein so as to receive either of the first or second handle halves 40/41 and the either of the first or second housing sections 61/62.

In this regard, the template 110 comprises a handle half receiving cavity 111 and a housing section-receiving cavity 112. The cavities 111 and 112 are sufficiently spaced longitudinally along the template 110 such that the tension member 33 and tubular structure 50 may be assembled directly to the handle half 40 or 41 and housing section 61 or 62 without having to manually displace or move the halves 40/41 and sections 61/62 relative to the length 53. From a comparative inspection of FIG. 19 versus FIG. 20 it will be seen that the cavity 111 may receive the handle half 40 and the cavity 112 may receive the housing section 61 such that the tubular structure 50 may be aligned and directly and respectively inserted into the portions 44 and 54 of the half 40 and section 61.

The method for assembling the aerosol container discharging apparatus 10 may thus be said to comprise a series of steps, including placing a first handle half such as handle half 40 in a first or handle half-receiving cavity 111 of a template 110 and placing a first housing section such as housing section 61 in a second or housing section-receiving cavity of the template 110 after forming the template 110 according to the desired specifications of the apparatus 10 including desired length of tubular structure 50, size and shape of the handle halves 40/41 and housing sections 61/62. The first handle half as at 40 may then be quickly and easily connected, for example, to the first housing section 61 via the tubular structure 50.

The tension member 33 is necessarily inserted through the tubular structure 50 so that the first tension member end 32 may be interconnected with the trigger unit 12 and the second tension member end 48 may be interconnected with the actuator assembly. The interconnected trigger unit 12 and first tension member end 32 may thereafter be placed into the firstly placed handle half (such as half 40) and the interconnected second tension member end 48 and actuator assembly may be placed into the firstly placed housing section (such as housing section 61). A container tension spring or certain retention means may be inserted into the firstly placed housing section before placing the secondly placed housing section on the firstly placed housing section.

In other words, once all internal components have been assembled or placed into proper position, a secondly placed handle half such as handle half 41 may thereafter be placed on the firstly placed handle half; and a secondly placed housing section may be placed on the firstly placed housing section. While placing the second handle half 41 on the first handle half 40, for example, the trigger or trigger unit 12 is thereby flange-mounted or track-mounted upon the flanges 31 of the handle assembly 30. In other words, the flanges 31 are received by the grooves 26 and thus the trigger unit 12 is mounted as if upon tracks (i.e. the flanges 31) for bidirectional displacement.

The actuator assembly may be preferably assembled before interconnecting the actuator assembly with the second tension member end 48. In this regard, it is contemplated that an actuator element such as element 75 and a crank element such as element 70 may be interconnected during the step of assembling the actuator assembly, and a spring assembly comprising compression spring 97 and spring post 98 may be assembled before interconnecting the spring assembly with the interconnected actuator and crank elements 75 and 70. The actuator assembly comprising the noted components may be further described as being post-fixed during the step of placing the second housing section 62 on the first housing section 61 since the post structure(s) 65 are received via the aperture 71 of the crank element 70 during assembly.

Fasteners (e.g. rivets 94) may then be outfitted with the handle halves 40/41 and housing sections 61/62 (i.e. inserted through handle-based fastener-receiving apertures 95 and housing-based fastener-receiving apertures 96) such that the fasteners may be simultaneously engaged (e.g. via a press mechanism 113) so as to fasten the second handle half 41 to the first handle half 40 and the second housing section 62 to the first housing section 61 thereby further fastening the tubular structure 50 with tube-enclosed or sleeve-enclosed tension member 33 to the handle assembly 30 and the operative end housing assembly 60. In other words, the step of simultaneously engaging the fasteners 94 may well operate to fasten the first and second handle halves 40/41 to a first tube end 51 of the tubular structure 50, and further operate to fasten the first and second housing sections 61 and 62 to a second tube 52 end of the tubular structure 50.

Figure 19:
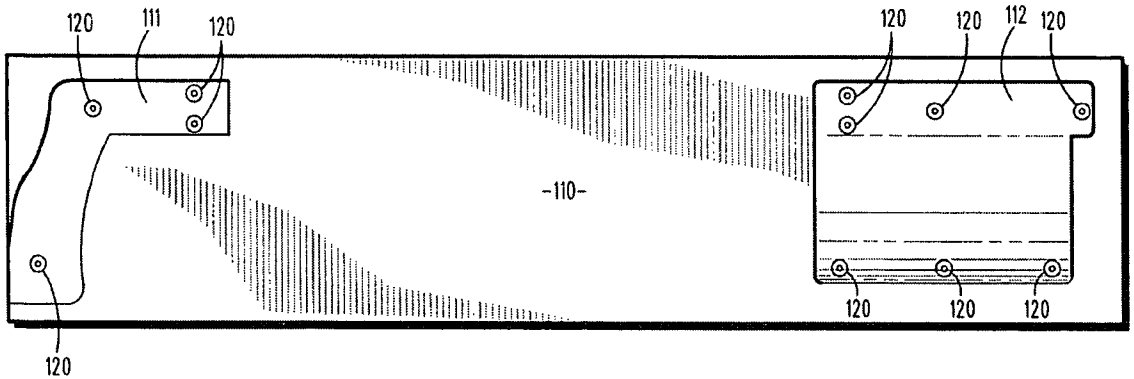
FIG. 19 is a top plan view of a template or assembly fixture showing a left handle half-receiving cavity and a right housing section-receiving cavity, each of which reveal the ends of fastener-engaging press posts extending through the template.
Figure 20:
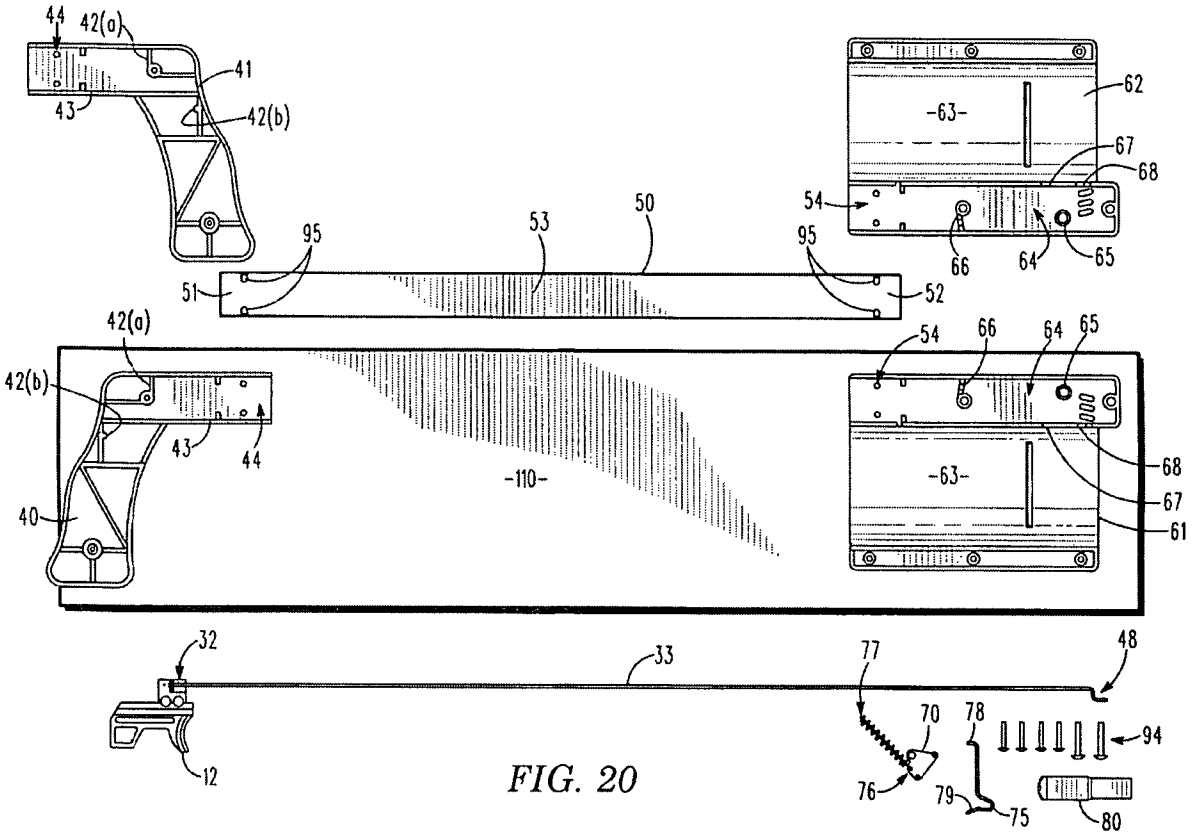
FIG. 20 is a top plan view of the template or assembly fixture otherwise shown in FIG. 19 showing a first handle half received in said handle half-receiving cavity and a first housing section received in said housing section-receiving cavity with additional components of the apparatus exploded from the template ready for assembly.
Figure 22A:
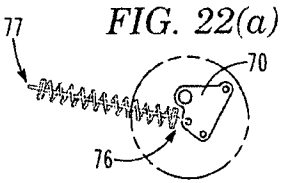
FIG. 22 is an enlarged plan view depiction of a bell-shaped crank element of the actuator assembly according to the present invention showing a series of apertures formed therein.
Figure 22:
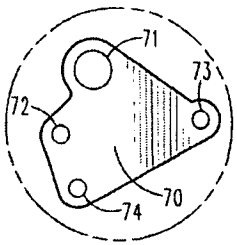
Figure 21:
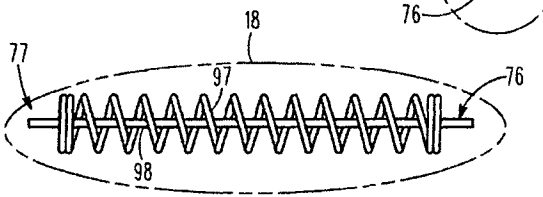
FIG. 21 is an enlarged side view depiction of a spring assembly of an actuator assembly according to the present invention.
Figure 23:
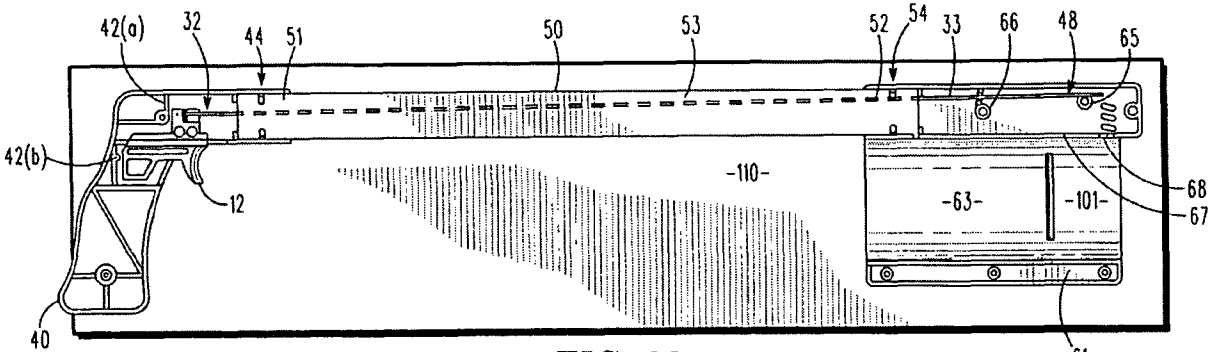
FIG. 23 is a top plan view of the template or assembly fixture showing a first handle half, a first housing section, a trigger unit, a tension member, and a tubular structure in assembled relation as supported by the template or assembly fixture according to the present invention.
Figure 24:
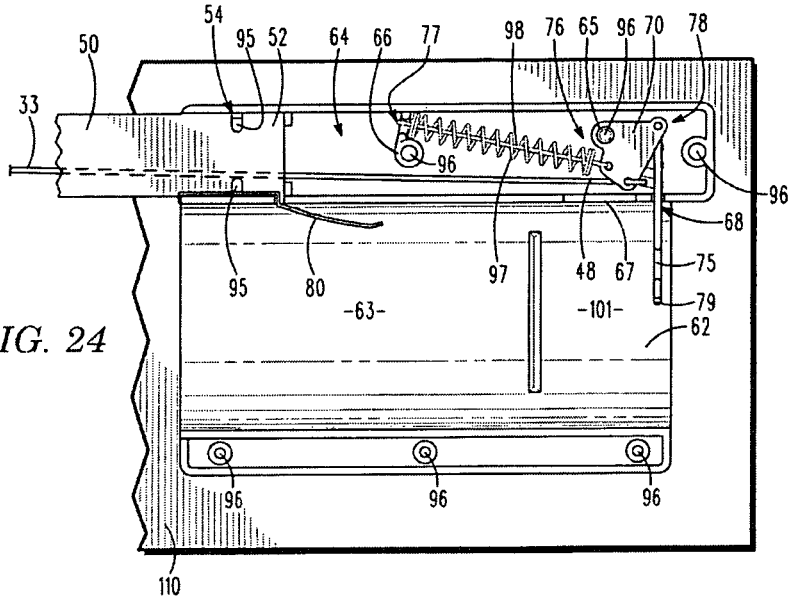
FIG. 24 is an enlarged top plan view of the container-receiving operative end (with a second housing section removed) of the aerosol container discharging apparatus according to the present invention showing the actuator assembly interconnected to an end of the tension member in a relaxed state.
Figures 28, 28A, 28B:
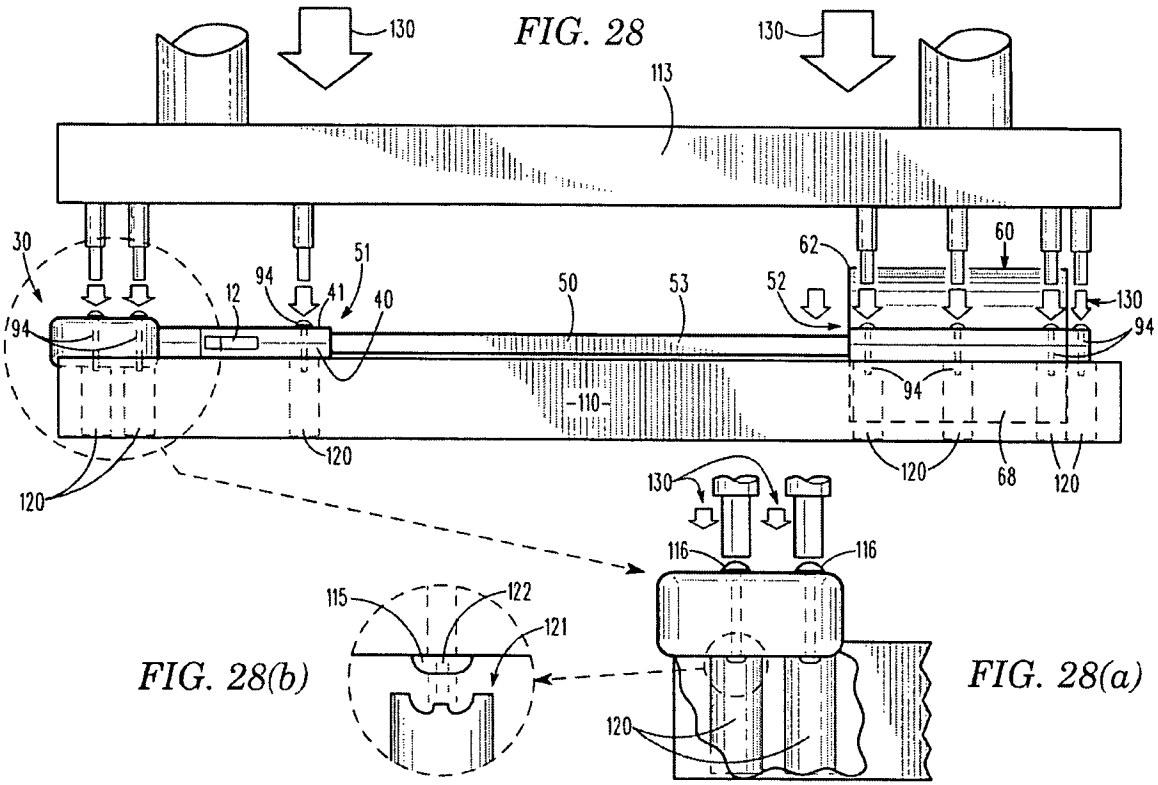
FIG. 28 is a side elevational type depiction of the assembly fixture or template otherwise depicted in FIG. 23 with a generic press being directed into the assembly fixture or template to respectively fasten by way of rivets a second handle half and a second housing section to the first handle half and the first housing section.

In this last regard, it is contemplated that the template 110 may be preferably outfitted with fastener-engaging press posts 120 as depicted and referenced in FIGS. 19, and 28-28 (*b*). Each press post 120 is preferably placed into the template 110 such that the posts 120 are axially aligned with the fastener-receiving apertures 96. It is contemplated that when the rivets 94 are inserted into the apertures 96, the insert ends 115 engage the upper ends 121 of the posts 120, which upper ends 121 are formed so as to re-direct or re-form the ends 115 into fastening configuration as generally depicted in FIG. 28(*b*) when a press force 130 is applied to the upper ends 116 of the rivets 94. The posts 120 may further be outfitted with guide pins 122 for directing the ends 115 into proper axial alignment with the posts 120.

Although the tubular structure 50 effectively interconnects the handle assembly 30 to the operative end housing assembly 60, it is contemplated that the method of assembly may preferably be performed by extending the second tension member end 48 of the tension member 33 through the tubular structure 50 (thereby inserting the tension member 33 through the tubular structure 50) before interconnecting the first handle half 40 with the first housing section 61 via the tubular structure 50.

Further, the step of interconnecting the first handle half 40 with the first housing section 61 may preferably comprise the steps of: simultaneously placing the first tension member end 32 and a first tube end 51 of the tubular structure 50 into the first handle half 40; and simultaneously placing the second tension member end 48 and a second tube end 52 of the tubular structure 50 into the first housing section 61.

It is further contemplated that the method of assembly may be preferably performed by interconnecting the trigger or trigger unit 12 and the first tension member end 32 before the step of inserting the tension member 33 through the tubular structure 50 while the step of interconnecting the actuator assembly with the second tension member end 48 may be preferably performed after the step of inserting the tension member 33 through the tubular structure 50.

Notably, the step of interconnecting the trigger or trigger unit 12 and the first tension member end 32 may be said to further and preferably comprise the sub-steps of: inserting the first tension member end 32 into a member-receiving aperture as at 36; rotating the tension member about an axis of rotation 106 extending through the first tension member end 32; and guide-locking the rotated tension member 33 via the member-guiding upright 29.

While the above description contains much specificity, this specificity should not be construed as limitations on the scope of the invention, but rather as an exemplification of the invention. For example, as is described hereinabove, it is contemplated that while the present invention essentially discloses an apparatus for discharging aerosol container contents, the essential apparatus is thought to be defined by an apparatus for enabling a user to ergonomically discharge aerosol container contents, which apparatus comprises a trigger unit, a handle assembly, a tension member, a tubular member, an operative end housing, and an actuator assembly.

The trigger unit 12 is believed to essentially comprise a finger-engaging portion 13, a trigger-guiding portion 14, and a member-receiving portion 15. The trigger-guiding portion 14 comprises certain trigger-based stop structure and handle-receiving grooves 26 opposedly extending into the width of said trigger-guiding portion 14. The member-receiving portion 15 comprises an apertured upright 36.

The finger-engaging portion 13 comprises a finger-engaging surface 16; the trigger-guiding portion 14 comprises a trigger-based stop structure and opposed handle-receiving grooves 26; and the member-receiving portion 15 comprises a planar, apertured upright as at 28. The apertured upright preferably comprises a member-receiving aperture as at 36, and a first basal cavity as at 90.

Figure 29:
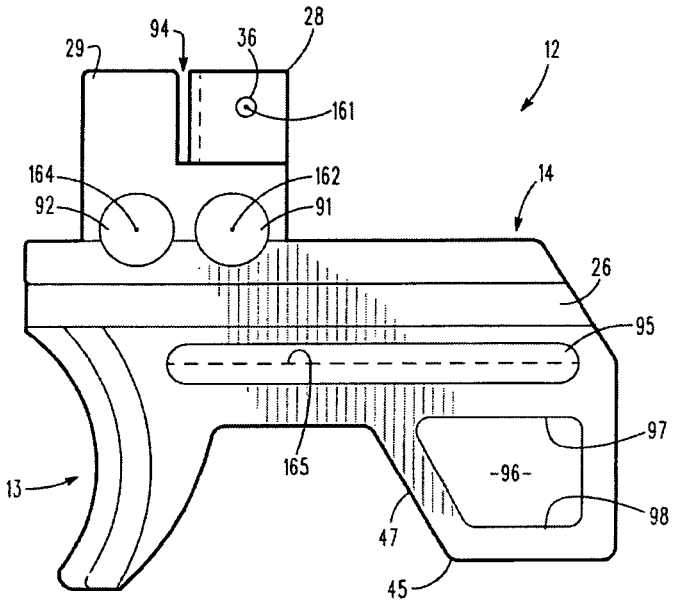
FIG. 29 is an enlarged view of the subject matter otherwise shown in FIG. 5, the enlarged view being presented for greater clarity of detail.
Figure 30:
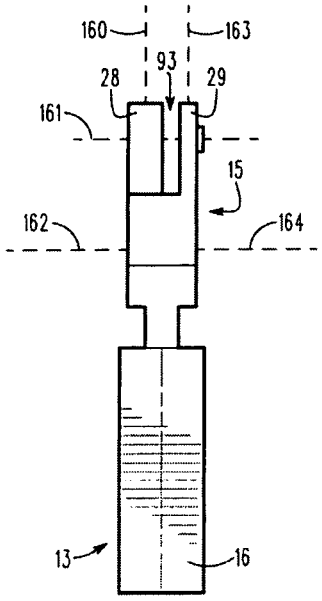
FIG. 30 is an enlarged view of the subject matter otherwise shown in FIG. 5(*d*), the enlarged view being presented for greater clarity of detail.
Figure 31:
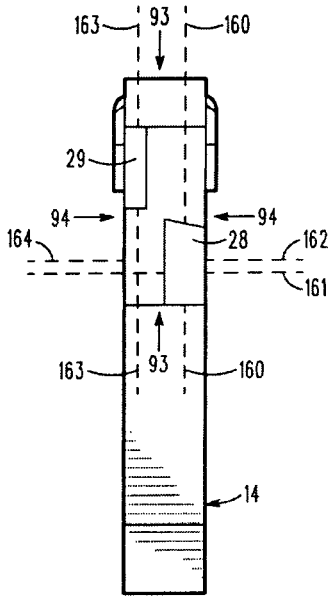
FIG. 31 is an enlarged view of the subject matter otherwise shown in FIG. 5(*a*), the enlarged view being presented for greater clarity of detail.

The apertured upright 28 extends orthogonally relative to the handle-receiving grooves 26 in an upright plane as at 160. The member-receiving aperture 36 comprises an aperture axis as at 161, and the first basal cavity 91 comprises a first cavity axis as at 162. The aperture and first cavity axes 161 and 162 are preferably orthogonal to the upright plane 160 and parallel to one another as generally and comparatively depicted in FIGS. 29-31.

The member-receiving portion 14 comprises a planar, member-guiding upright 29. The member-guiding upright 29 extends in a guide plane 163 parallel to the upright plane 161, The member-guiding upright 29 comprises a second basal cavity as at 92, which second basal cavity 92 comprises a second cavity axis as at 164. The second cavity axis 164 is parallel to the first cavity axis 162 in a plane parallel the aperture axis 161.

The member-guiding and apertured uprights 28 and 29 thereby together define a planar, member-receiving channel as at 93. The member-receiving channel 93 functions to receive the outwardly extending portion 39 of the L-shaped tension member 33 when pivoted into an operable position. The member-guiding upright 29 thus functions to prevent axial displacement of the first end of the L-shaped tension member 33 relative to the upright plane 160 for preventing removal thereof from the apertured upright 28.

The member-guiding upright 29 is forward of the apertured upright 28 thereby forming a forward channel as at 94. The forward channel 94 is preferably orthogonal to the member-receiving channel 93 such that the forward and member-receiving channels 93 and 94 together enhance tension member receipt and securement.

The trigger-guiding portion 14 preferably comprises a guide length 20 and a trapezoidal portion 45. The guide length 20 preferably comprises a guide length cavity 95. The handle-receiving grooves 26 are formed parallel to one another along the guide length 20, and the guide length cavity 95 extends parallel to the handle-receiving grooves 26 in a cavity plane 165.

The trapezoidal portion 45 comprises an angled first side 47 and a trapezoidal cavity as at 96. The trapezoidal cavity 96 comprises a major base 97 and a minor base 98. The major and minor bases 97 and 98 are also parallel to the guide length cavity 95. The angled first side 47 is substantially coplanar with the angled portion 46 of the handle assembly 30 when the forward handle-based stop structure cooperably interacts with the trigger-based stop structure for preventing excess forward movement of the trigger unit 12.

The handle assembly 30 essentially comprises opposed guide flanges 43, handle-based stop structure, and a first tube-interfacing portion. The handle-receiving grooves 26 of the trigger unit 12 receive the guide flanges 43 of the handle assembly 30 and are bidirectionally displaceable therealong. The trigger-based and handle-based stop structure(s) prevent excess bidirectional movement of the trigger unit 12 within the handle assembly 30. The L-shaped tension member 33 as preferably defined by a relatively thin gauge wire element comprises first and second tension member ends and a member length extending therebetween. The first tension member end is received by the aperture 36 formed in the apertured upright 28 of the trigger unit 12.

The tubular member has first and second tube ends and a tube length extending therebetween. The first tube-interfacing portion of the handle assembly interfaces with the first tube end, and the member length of the tension member is received by the tube length. The operative end housing comprises a second tube-interfacing portion, a container-receiving portion, and an actuator-receiving portion.

The actuator-receiving portion has a post structure and spring stop structure. The container-receiving and actuator-receiving portions are separated by a common apertured wall. The actuator assembly comprises an apertured crank element, a spring assembly, and an actuator element. The spring assembly has first and second spring ends, and the actuator element has first and second actuator ends.

A first aperture formed in the crank element rotatably receives the post structure; a second aperture formed in the crank element receives the first spring end; a third aperture formed in the crank element receives the first actuator end; and a fourth aperture formed in the crank element receives the second tension member end.

The spring stop structure prevents movement of the second spring end, and the actuator member extends through the apertured wall such that the second actuator end is displaceable within certain space defined by the container-receiving portion. The container-receiving portion is sized and shaped to receive an aerosol container.

The trigger unit receives a manually (finger-initiated) pull force for selectively displacing the tension member in a first (rearward) direction thereby transmitting force to the rotatable crank element as biased by the spring assembly for rotating the crank element and displacing the second actuator end for actuating (a nozzle 9 of) the aerosol container as received by the operative end housing.

The trigger mechanism according to the present invention may be said to essentially comprise a (molded) trigger unit, a tension member, and a handle assembly. The molded trigger unit comprises a finger-engaging portion, a trigger-guiding portion, and a (tension) member-receiving portion.

The finger-engaging portion comprises a finger-engaging (saddle-shaped) surface, a (maximum) trigger width, a top trigger terminus, and a bottom trigger terminus. The trigger-guiding portion comprises a guide length, a guide width, a guide height, guide stop structure, a guide top, and handle-receiving grooves (or channels) opposedly extending into the guide width. The member-receiving portion comprises a base portion, an apertured upright, and a member-guiding upright.

In function, the finger-engaging surface ergonomically receives a user's finger. The handle-receiving grooves receive the opposed guide flanges of a handle assembly, and the guide stop structure prevents excess forward and rearward movement of the molded trigger unit. The apertured upright receives a first end of a tension member, and the member-guiding upright prevents the tension member from becoming removed from the apertured upright.

In addition to the foregoing structural considerations, it is further believed that the inventive concepts discussed support certain new methods and/or processes for assembling the apparatus and/or trigger mechanism. In this regard, it is contemplated that the detailed specifications support a certain apparatus assembly process wherein the steps may be said to include placing a first handle half in a first template-based cavity and placing a first housing section in a second template-based cavity whereafter the first handle half and first housing section may be interconnected via a tubular structure.

A tension member may, at some point in the process be inserted through the tubular structure, and a trigger or trigger unit may be interconnected with a first tension member end of the tension member. The interconnected trigger and first tension member end may thus be placed into the first handle half. Similarly, an actuator assembly may be interconnected with a second tension member end of the tension member, and the interconnected second tension member and actuator assembly may be placed into the first housing section.

After internal parts are assembled (and properly and precisely positioned via the template), a second handle half may be placed on the first handle half, and a second housing section may be placed on the first housing section. Fasteners such as rivets may then be simultaneously engaged so as to fasten the second handle half to the first handle half and the second housing section to the first housing section thereby further fastening the handle assembly and operative end housing assembly to the other noted components to render a fully assembled apparatus for discharging aerosol container contents.

Accordingly, although the invention has been described by reference to certain preferred embodiment(s) and certain assembly methodology, it is not intended that the novel arrangement and methods be limited thereby, but that modifications thereof are intended to be included as falling within the broad scope and spirit of the foregoing disclosures and the appended drawings.

I claim:

1. A trigger mechanism for enabling a user to ergonomically discharge aerosol container contents, the trigger mechanism comprising:

a trigger unit, the trigger unit comprising a finger-engaging portion, a trigger-guiding portion, and a member-receiving portion, the finger-engaging portion comprising a finger-engaging surface, the trigger-guiding portion comprising trigger-based stop structure and opposed handle-receiving grooves, the member-receiving portion comprising a planar, apertured upright and a planar, member-guiding upright, the apertured upright comprising a member-receiving aperture and a first basal cavity, the apertured upright extending orthogonally relative to the handle-receiving grooves in an upright plane, the member-receiving aperture comprising an aperture axis for receiving a first end of an L-shaped tension member, the first basal cavity comprising a first cavity axis, the aperture and first cavity axes being orthogonal to the upright plane and parallel to one another, the member-guiding upright extending in a guide plane parallel to the upright plane, the member-guiding upright comprising a second basal cavity, the second basal cavity comprising a second cavity axis, the second cavity axis being parallel to the first cavity axis, the member-guiding and apertured uprights thereby together defining a planar, member-receiving channel, the member-receiving channel for receiving the L-shaped tension member when pivoted into an operable position, the member-guiding upright for preventing axial displacement of the first end of the L-shaped tension member relative to the upright plane for preventing removal thereof from the apertured upright, the finger-engaging surface for ergonomically receiving a user's finger, the handle-receiving grooves for receiving opposed guide flanges of a handle assembly, the trigger-based stop structure for preventing excess forward and rearward movement of the trigger unit.

2. The trigger mechanism of claim 1 wherein the finger-engaging portion comprises a trigger width and the trigger-guiding portion comprises a guide width, the trigger width being greater than the guide width for enhancing comfort of the trigger unit during usage.

3. The trigger mechanism of claim 2 wherein the finger-engaging surface is saddle-shaped for enhancing ergonomic receipt of the user's finger.

4. The trigger mechanism of claim 1 wherein the trigger-guiding portion comprises a guide length, the guide length comprising a guide length cavity, the handle-receiving grooves being formed parallel to one another along the guide length, the guide length cavity being parallel to the handle-receiving grooves.

5. The trigger mechanism of claim 1 wherein the member-guiding upright is forward of the apertured upright thereby forming a forward channel, the forward channel being orthogonal to the member-receiving channel, the forward and member-receiving channels for enhancing tension member receipt and securement.

6. The trigger mechanism of claim 1 comprising, in combination, the L-shaped tension member.

7. The trigger mechanism of claim 4 comprising, in combination, the handle assembly, the handle assembly comprising rear and forward handle-based stop structure for cooperably interacting with the trigger-based structure for preventing excess forward and rearward movement of the trigger unit.

8. The trigger mechanism of claim 7 wherein the trigger-guiding portion comprises a trapezoidal portion and the handle assembly comprises an angled portion, the trapezoidal portion having an angled first side and a trapezoidal cavity, the trapezoidal cavity comprising a major base and a minor base, the major and minor bases being parallel to the guide length cavity, the angled first side being substantially coplanar with the angled portion when the forward handle-based stop structure cooperably interacts with the trigger-based stop structure for preventing excess forward movement of the trigger unit.

9. The trigger mechanism of claim 8 wherein the trigger unit comprises spacing intermediate the finger-engaging portion and the angled first side, the spacing being sized and shaped to receive a user's non-trigger finger when the rearward handle-based stop structure cooperably interacts with the trigger-based stop structure for preventing excess rearward movement of the trigger unit.

10. A trigger mechanism for enabling a user to discharge aerosol container contents, the trigger mechanism comprising:

a trigger unit, the trigger unit comprising a finger-engaging portion, a trigger-guiding portion, and a member-receiving portion, the finger-engaging portion comprising a finger-engaging surface, the trigger-guiding portion comprising trigger-based stop structure and a handle-receiving groove, the member-receiving portion comprising a planar, apertured upright and a planar, member-guiding upright, the apertured upright comprising a member-receiving aperture, the apertured upright extending orthogonally relative to the handle-receiving groove in an upright plane, the member-receiving aperture comprising an aperture axis, the aperture axis being orthogonal to the upright plane for receiving a first end of a tension member, the member-guiding upright extending in a guide plane parallel to the upright plane, the member-guiding and apertured uprights thereby together defining a planar, member-receiving channel, the member-guiding upright being forward of the apertured upright thereby forming a forward channel, the forward channel being orthogonal to the member-receiving channel, the forward and member-receiving channels for enhancing tension member receipt and securement, the member-receiving channel for receiving the tension member when pivoted into an operable position, the member-guiding upright for preventing the tension member from becoming removed from the apertured upright, the finger-engaging surface for receiving a user's finger, the handle-receiving groove for receiving a guide flange of a handle assembly, the trigger-based stop structure for preventing excess forward and rearward movement of the trigger unit.

11. The trigger mechanism of claim 10 wherein the finger-engaging portion comprises a trigger width and the trigger-guiding portion comprises a guide width, the trigger width being greater than the guide width for enhancing comfort of the trigger unit during usage.

12. The trigger mechanism of claim 11 wherein the finger-engaging surface is saddle-shaped for enhancing ergonomic receipt of the user's finger.

13. The trigger mechanism of claim 10 wherein the trigger-guiding portion comprises a guide length, the guide length comprising a guide length cavity, the apertured upright comprising a first basal cavity, and the member-guiding upright comprising a second basal cavity, the guide length cavity being parallel to the handle-receiving groove, the first and second basal cavities each comprising a cavity axis, the cavity axes being parallel to one another and the aperture axis, the handle-receiving groove being formed along the guide length.

14. The trigger mechanism of claim 10 comprising, in combination, the tension member.

15. The trigger mechanism of claim 10 comprising, in combination, the handle assembly, the handle assembly comprising rear and forward handle-based stop structure for cooperably interacting with the trigger-based structure for preventing excess forward and rearward movement of the trigger unit.

16. The trigger mechanism of claim 15 wherein the trigger-guiding portion comprises a trapezoidal portion and the handle assembly comprises an angled portion, the trapezoidal portion having an angled first side and a trapezoidal cavity, the trapezoidal cavity comprising a major base and a minor base, the major and minor bases being parallel to the guide length cavity, the angled first side being substantially coplanar with the angled portion when the forward handle-based stop structure cooperably interacts with the trigger-based stop structure for preventing excess forward movement of the trigger unit.

17. The trigger mechanism of claim 16 wherein the trigger unit comprises spacing intermediate the finger-engaging portion and the angled first side, the spacing being sized and shaped to receive a user's non-trigger finger when the rearward handle-based stop structure cooperably interacts with the trigger-based stop structure for preventing excess rearward movement of the trigger unit.

18. A trigger mechanism for enabling a user to discharge aerosol container contents via an aerosol container discharging apparatus, the trigger mechanism comprising:

a finger-engaging portion, a trigger-guiding portion, and a member-receiving portion, the finger-engaging portion comprising a finger-engaging surface, the trigger-guiding portion comprising a handle-guiding groove, the member-receiving portion comprising an apertured upright and a member-guiding upright, the apertured upright comprising a member-receiving aperture, the apertured upright extending orthogonally relative to the handle-receiving groove in an upright plane, the member-receiving aperture comprising an aperture axis, the aperture axis being orthogonal to the upright plane for receiving and thereby linking a first end of a tension member to the trigger mechanism, the member-guiding upright extending in a guide plane parallel to the upright plane, the member-guiding and apertured uprights thereby together defining a member-receiving channel, the member-guiding upright being forward of the apertured upright thereby forming a forward channel, the forward channel being orthogonal to the member-receiving channel, the forward and member-receiving channels for enhancing tension member receipt and securement, the member-receiving channel for receiving the tension member when pivoted into an operable position, the member-guiding upright for preventing the tension member from becoming removed from the apertured upright, the finger-engaging surface for receiving a user's finger, the handle-guiding groove for cooperably guiding handle assembly guide structure.

19. The trigger mechanism of claim 18 wherein the trigger-guiding portion comprises a trapezoidal portion, the trapezoidal portion having an angled first side and a trapezoidal cavity, the trapezoidal cavity comprising a major base and a minor base, the major and minor bases being parallel to the handle guiding groove, the angled first side for preventing excess forward movement of the trigger unit.

20. The trigger mechanism of claim 19 comprising wherein the trigger unit comprises spacing intermediate the finger-engaging portion and the angled first side, the spacing being sized and shaped to receive a user's nor.-trigger finger for preventing excess rearward movement of the trigger unit.

21. A trigger mechanism for enabling a user to ergonomically discharge aerosol container contents, the trigger mechanism comprising:

a trigger unit, the trigger unit comprising a finger-engaging portion, a trigger-guiding portion, and a member-receiving portion, the finger-engaging portion comprising a finger-engaging surface, the trigger-guiding portion comprising trigger-based stop structure and opposed handle-receiving grooves, the opposed handle-receiving grooves for defining bi-directional motion of the trigger unit, the member-receiving portion comprising a planar, apertured upright and a member-guiding upright, the apertured upright comprising a member-receiving aperture and a first basal aperture, the apertured upright extending orthogonally relative to the handle-receiving grooves and the bi-directional motion of the trigger unit in an upright plane, the member-receiving aperture comprising a first aperture axis for receiving a first end of an L-shaped tension member, the first basal aperture comprising a second aperture axis, the member-guiding upright extending in a guide plane parallel to the upright plane, the member-guiding and apertured uprights thereby together defining a member-receiving channel, the member-receiving channel for receiving the tension member when pivoted into an operable position, the member-guiding upright for preventing the tension member from becoming removed from the apertured upright, the first and second aperture axes being orthogonal to the upright plane and parallel to one another, the finger-engaging surface for ergonomically receiving a user's finger, the handle-receiving grooves for receiving opposed guide flanges of a handle assembly, the trigger-based stop structure for preventing excess forward and rearward movement of the trigger unit.

* * * * *